United States Patent [19]

Bourgeois

[11] Patent Number: 4,913,278

[45] Date of Patent: Apr. 3, 1990

[54] APPARATUS FOR FEEDING SYRINGES INTO A CARTONING MACHINE WITH SLOTS

[75] Inventor: Emmanuel Bourgeois, Gien, France

[73] Assignee: Rhone-Poulenc Sante Propharm, Paris, France

[21] Appl. No.: 280,585

[22] Filed: Dec. 6, 1988

[30] Foreign Application Priority Data

Dec. 7, 1987 [FR] France ..... 87 16956

[51] Int. Cl.[4] ..... B65G 33/04

[52] U.S. Cl. ..... 198/464.4; 198/467.1; 198/722

[58] Field of Search ..... 198/464.4, 467.1, 722, 198/657, 661, 670, 676

*Primary Examiner*—Frank E. Werner
*Assistant Examiner*—D. Glenn Dayoan
*Attorney, Agent, or Firm*—Stevens, Davis, Miller & Mosher

[57] ABSTRACT

Apparatus for feeding syringes into a cartoning machine in which the syringes slide down the feed section 10 of a guide 1 to a substantially horizontal central section 12. Rotatable adjacent this central section is a feed worm 2, the threads of which are of decreasing depth. As the syringes are fed forwardly toward a discharge section 14, the plungers of the syringes are forced to a fully inserted position by the decreasing depth of the thread.

6 Claims, 4 Drawing Sheets

Fig.3.
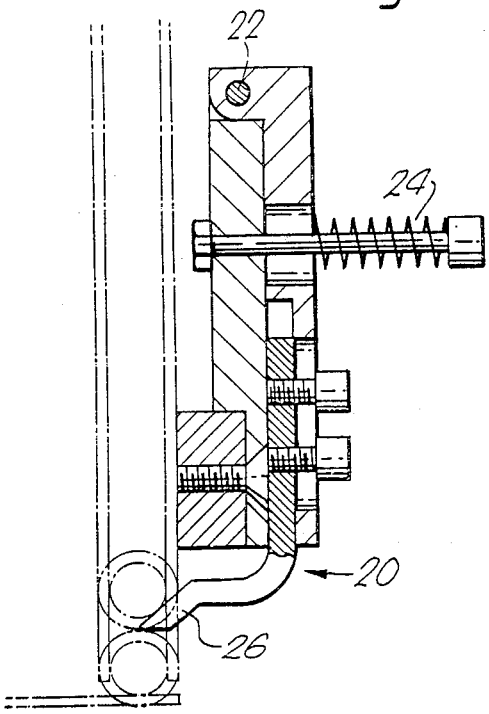
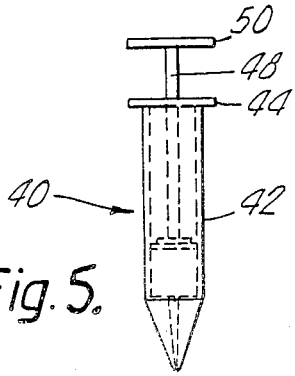
Fig. 5.

APPARATUS FOR FEEDING SYRINGES INTO A CARTONING MACHINE WITH SLOTS

The present invention relates to apparatus for feeding syringes into a cartoning machine with slots.

In the pharmaceuticals industry the packaging of a medicinal product is of very particular importance. The presentation of a pharmaceutical composition must be such that the patient can use it easily without any risk of error as regards the amount of composition to be administered.

A pharmaceutical composition is frequently presented in a liquid form to be administered orally. The dosage of the medicament is based on the administration of a certain number of drops or of a specific volume of the composition at various times of the day according to the directions of the doctor. It is thus particularly important for the patient to be able to follow the treatment prescribed without any risk of error. In order to do this the pharmacist packaging the pharmaceutical composition must combine, with the bottle containing the composition, a device making it possible to withdraw and distribute the necessary dose, such as a drop counter or a graded syringe. The pharmacist must therefore have available a machine making it possible simultaneously to introduce, into the carton packaging, the bottle containing the composition and the drop counter or syringe, the packaging having to be carried out at as high a rate as possible.

In the specific case of syringes one problem arises from the fact that, in the syringes supplied by the manufacturer, the plungers are not always in their position of maximum insertion. It is necessary, prior to the feeding of the syringes into the slots of a cartoning machine, to have available an apparatus which can bring the plungers of all the syringes into the position of maximum insertion and which makes it possible to feed them into the slots of the cartoning machine such that, for each flask to be packaged, there corresponds one syringe.

According to the present invention, there is provided apparatus for feeding syringes into a cartoning machine with slots, which syringes include an elongate body of a given length and diameter, an outwardly projecting collar of a larger diameter at one end of the body and a plunger of a given length which is moveable within said body and extends out of said one end, said apparatus comprising a guide formed of two parallel surfaces, the spacing of which is greater than that of said given diameter, but smaller than the diameter of the collar, said guide including a downwardly inclined feed section, a central substantially horizontal section and a downwardly inclined discharge section, a helical feed worm mounted for rotation on an axis parallel to said central section of the guide, flights of said worm positioned immediately adjacent to said parallel surfaces of said central section of said guide, said flights forming the thread of the worm, the depth of said thread decreasing from the feed section end to the discharge section end, effective to force the plunger of a syringe fully into the body of the syringe, as it reaches the discharge section and an ejector adapted to retain a syringe at the lower end of the discharge section, until it is forced out by a subsequently fed syringe. With such a construction it is possible to produce a regular feeding of the syringes, whose plunger is fully inserted, into the slots of a cartoning machine.

Advantageously the length of the central section is substantially equal to the length of the worm. It is possible for the discharge section to take many forms including a downwardly linked straight guide. Preferably, however, the discharge section includes a quadrant of a circle whereby said syringes are presented at said ejector with their axes in the horizontal positions, the radius of said circle being a function of the length of the syringe, the diameter of the syringe and the diameter of the collar, and the angle of the cone formed by the tip of the syringe and further comprising a further arcuate guide concentric with said quadrant of a circle and spaced from said quadrant by a distance equal to the projection of the plunger from the collar.

Desirably the depth of the thread of said worm at the end thereof adjacent said feed section is equal to about 0.8 times the length of the plunger, wherein the depth of the thread adjacent the discharge section is equal to the length of the plunger above the collar when the plunger is fully inserted and wherein the pitch of the threads is equal to or slightly greater than the diameter of the collar.

It is preferred to provide with the upper guide means for detection a syringe without a plunger. These means may include, on said upper guide, an openable door, spring means urging said door to said open position, a latch retaining said door in its closed position, and a feeler positioned to be engaged by the head of a plunger, absence of a plunger causing said feeler to move to disengage said latch and further comprising means to stop rotation of said worm upon opening of said door.

In order that the present invention may more readily be understood, the following description is given merely by way of example, reference being made to the accompanying drawings in which:

FIG. 3 is an enlarged view of the ejector of the apparatus of FIG. 1;

FIG. 5 illustrates a syringe to be handled by the apparatus of the invention.

Figure 1:
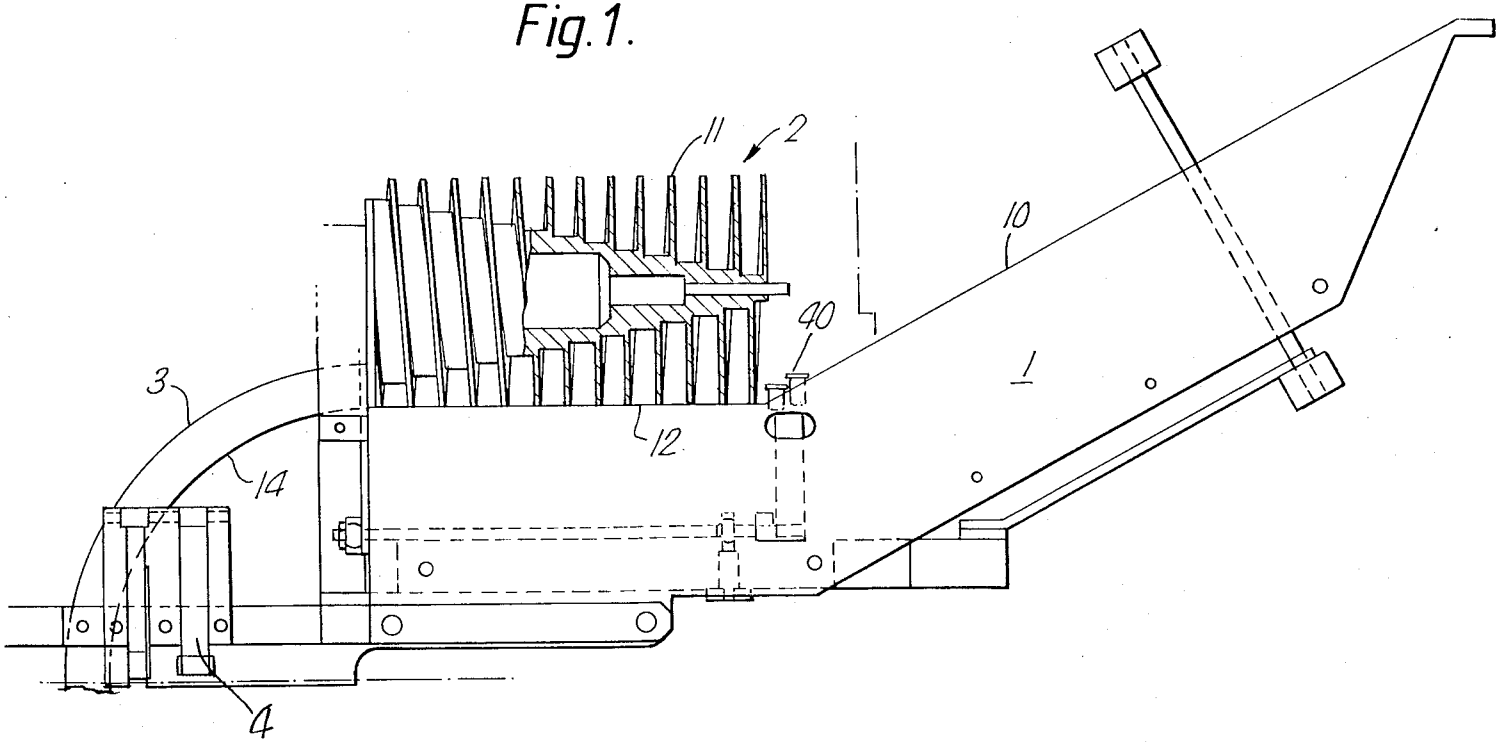
FIG. 1 is a side elevation of one embodiment of apparatus according to the invention.

The syringe 40 illustrated in FIG. 5 includes a cylindrical body 42 of a given diameter and length, having an outwardly projecting external collar 44 of a larger diameter at one end. A plunger 48 is axially moveable within the body and projects out of said one end of the body. At its outer end the plunger includes a head 50.

The apparatus illustrated in FIG. 1 includes a guide 1, a helical feed worm 2 making it possible to advance the syringes while inserting the pistons, and an ejector 4.

The guide 1 is formed by the upper edges of two parallel vertical surfaces generally consisting of two metal plates the spacing of which is slightly greater that the diameter of the syringes and smaller than the diameter of the collar of the syringes, and between which the syringes can move in a vertical plane.

The guide is composed of three sections:

(a) a downwardly inclined feed section 10 forming, with a horizontal plane, an angle of between 25° and 35°, preferably approximately 30°, making it possible for the syringes, distributed by one or more bowl feeders, to descend by gravity, and having a minimum length of 20 cm such that there is sufficient charge at the worm entry, (b) a central substantially horizontal section 12 whose length corresponds to that of the feed worm 2 described hereinafter, (c) a discharge section 14 in the form of a quadrant of a circle. This makes it possible to present the syringes in the horizontal position for their ejection into the slots of the cartoning machine. The radius of the quadrant of a circle is a function of the length of the syringe (between the collar and the tip), the diameter of the syringe, the diameter of the collar and the angle of the cone formed by the tip. Thus, the radius of the quarter circle will be approximately twice the length of the syringe (between the collar and the tip) for a syringe whose diameter is approximately 1/10th of the length of the syringe, whose collar diameter is approximately 1/5th of the length of the syringe, and in which the angle of the cone formed by the tip is approximately 10°. In this quarter-circle zone the syringes are stacked one against the other, each syringe being pushed by the following one.

The discharge section 14 is covered, over its entire length, at a distance corresponding to the space between the bottom of the collar and the top of the plunger (the latter being fully inserted), by an upper guide 3 in the shape of the arc of a circle and whose surface is perpendicular to the vertical plane of the two sheets constituting the guide. The upper guide makes it possible to maintain the collars of the syringes in contact with the discharge section 14. Moreover, this upper guide 3 can contain a device permitting detection of the syringes which do not contain a plunger.

Figure 2:
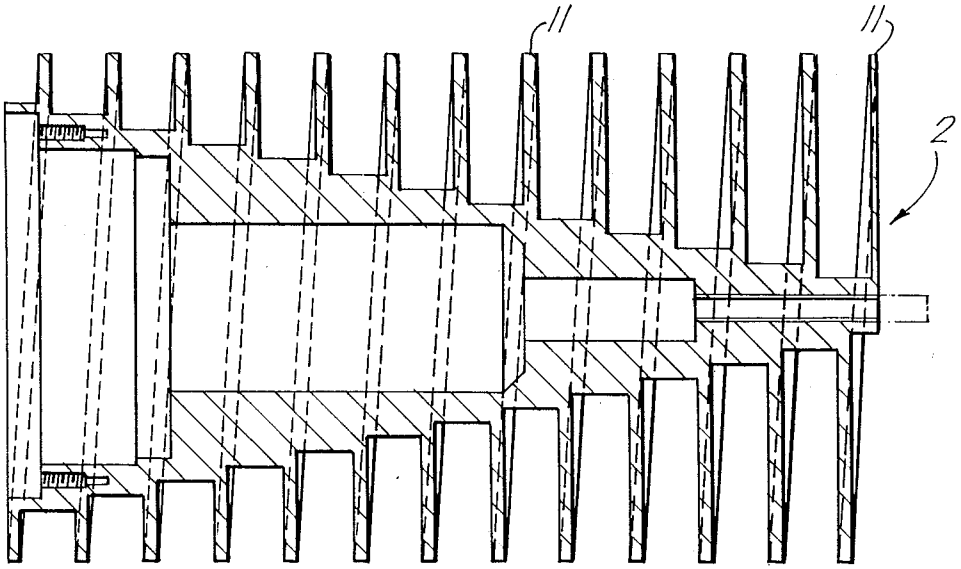
FIG. 2 is an enlarged view of the worm of the apparatus of FIG. 1.

The worm 2 shown in FIG. 2, and whose axis is substantially horizontal, comprises threads (11) of decreasing depth, the flights of the thread being positioned immediately adjacent the central section 12 of the guide 1. The thread situated nearest the feed section of the guide has a depth of about 0.8 times the length of the plunger 48, and that situated nearest the discharge section has a depth equal to the length of the plunger 48 above the collar 44, when the plunger 48 is fully inserted. The width of each thread is equal to or slightly greater than the diameter of the collar 44. The endless worm generally comprises 10 to 16 threads, and is actuated by a motor which is, preferably, a compressed air motor or an electric motor (not shown).

The ejector 4, which is shown in more detail in FIG. 3, is made up of an arm 20 moveable about an axis 22 situated in the lower part of the discharge section 14. The arm is provided with a return spring 24. A feeler 26 is adjustably mounted on the arm to permit the control of the movement of the feeler.

The feeler triggers the ejection of a syringe into a slot of the cartoning machine.

The apparatus according to the invention functions in the following way:

(1) the syringes are fed to the feed section 10 of the guide by means of one or more bowl feeders and they descend by gravity, in a vertical plane, towards the first thread of the worm 2, (2) on each revolution, the worm receives a syringe at its entry (the deepest thread) and releases one at its outlet (shallowest thread). The thread of the worm takes the syringe at the level of its collar to advance it by virtue of its pitch and at the level of the head of the plunger to be inserted by virtue of its decreasing depth. The worm is driven by a compressed air motor which is controlled for one turn each time it is necessary to deliver a syringe as a slot of the cartoning machine passes, (3) the syringes emerging from the worm are pushed by the worm into the discharge section of the guide and stacked one on the other.

The worm only stops when a syringe forces the feeler to the maximum opening. This position of the feeler is detected by a probe; it is by means of this probe that the motor of the screw is stopped.

In order to eject a syringe into a slot, an impulse synchronized with the passage of the latter triggers the screw. At this moment the syringe, which was held in its diameter by the feeler opened to the maximum, is pushed sufficiently so that the feeler can no longer retain it; on the contrary, it ejects it and closes completely behind it by virtue of its spring. The feeler is then in the rest position and its probe is released to initiate rotation of the worm until a new syringe sets the feeler in the maximum opening position.

As the following slot passes, an impulse will again trigger the worm and the cycle restarts.

The speed of rotation of the motor actuating the worm is adjusted according to the passing speed of the slots so that it has a substantially continuous rotation.

The apparatus according to the invention makes it possible to release the syringes at a rate of approximately 7,200 per hour; higher rates can be envisaged with motors having higher speeds.

Figure 4:
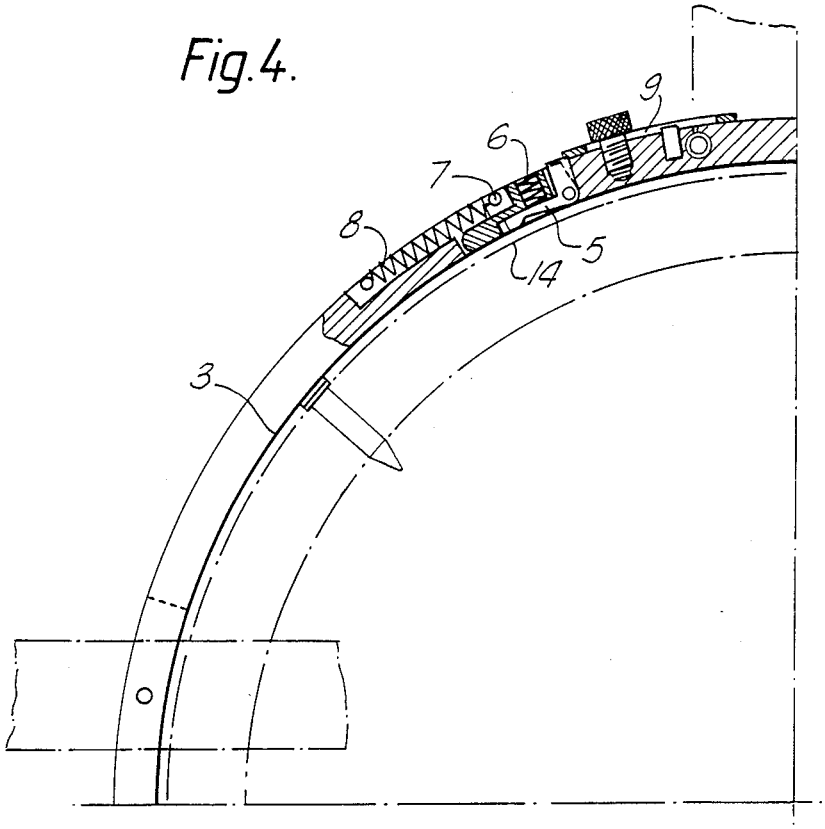
FIG. 4 is an enlarged view of the discharge section of the guide and of means for detecting the presence of the plungers of the syringe fed by the apparatus of FIG. 1.

The upper guide 3 covering the discharge section can contain a device for detecting "faulty" syringes, that is to say syringes coming from the bowl feeders which do not have any plunger. This device is shown in FIG. 4. In the thickness of the metal piece forming the upper guide 3 there is an arrangement in which there is fitted a door 7 provided with a spring 8 which tends to open it. A latch 5 associated with the spring 6 retains the door in its closed position.

A curved feeler plate 9 makes it possible to exercise control on the escape of the latch; the travel of the latch necessary for opening the door will be more or less long depending on its adjustment.

The heads of the plungers of the syringes are in permanent contact with the wall of the guide 3 and, in particular, with the latch 5. In the absence of a plunger the latch is released, triggering the opening of the door and causing the complete stopping of the apparatus, by virtue of a door-presence sensor. The cartoning machine continues to ensure the packaging of the flasks, together with their syringe, which had been deposited in the slots before the malfunction.

The syringe without a plunger is situated opposite the opening of the door 7, and it can therefore be easily removed. It then suffices to close the door which locks automatically since the worm 2 begins to rotate again and brings new syringes (with plungers) under the latch of the door.

I claim:

1. Apparatus for feeding syringes into a cartoning machine with slots, which syringes include an elongate body of a given length and diameter, an outwardly projecting collar of a larger diameter at one end of the body and a plunger of a given length which is movable within said body and extends out of said one end, said apparatus comprising a guide formed of two parallel surfaces, the spacing of which is greater than that of said given diameter, but smaller than the diameter of the collar, said guide including a downwardly inclined feed section, a central substantially horizontal section and a downwardly inclined discharge section, a helical feed worm mounted for rotation on an axis parallel to said central section of the guide, flights of said worm positioned immediately adjacent to said parallel surfaces of said central section of said guide, whereby rotation of the worm pushes syringes along said central section of the guide from the feed section to the discharge section thereof, said flights forming the thread of the worm, the depth of said thread decreasing from the feed section end to the discharge section end, effective to force the plunger of a syringe fully into the body of the syringe, as it reaches the discharge section and an ejector adapted to retain a syringe at the lower end of the discharge section, until it is forced out by a subsequently fed syringe.

2. Apparatus as claimed in claim 1, wherein the length of said central section is substantially equal to the length of said worm.

3. Apparatus as claimed in claim 1, wherein said discharge section includes quadrant of a circle whereby said syringes are presented at said ejector with their axes in the horizontal position, the radius of said circle being a function of the length of the syringe,the diameter of the syringe and the diameter of the collar, and the angle of the cone formed by the tip of the syringe and further comprising an upper arcuate guide concentric with said quadrant of a circle and spaced from said quadrant by a distance equal to the projection of the plunger from the collar.

4. Apparatus as claimed in clam 1, wherein the depth of the thread of said worm at the and thereof adjacent said feed section is equal to about 0.8 times the length of the plunger, wherein the depth of the thead adjacent the discharge section is equal to the length of the plunger above the collar when the plunger is fully inserted and wherein the pitch of the threads is equal to or slightly greater than the diameter of the collar.

5. Apparatus as claimed in claim 3, wherein said upper arcuate guide further comprises means for detecting syringes without a plunger.

6. Apparatus as claimed in claim 5, wherein said means for detecting syringes without a plunger comprises, on said upper arcuate guide, an openable door, spring means urging said door to said open position, a latch retailing said door in its closed position, and a feeler positioned to be engaged by the head of a plunger, absence of a plunger causing said feeler to move to disengage said latch.

* * * * *